US006374881B1

(12) United States Patent
Wiklund et al.

(10) Patent No.: US 6,374,881 B1
(45) Date of Patent: Apr. 23, 2002

(54) METHOD FOR CUTTING UP LOGS

(75) Inventors: Kjell Anders Wiklund, Kåge; Hans Holmberg, Danderyd; Dick Sandberg, Stockholm; Martin Wiklund, Täby, all of (SE)

(73) Assignee: Primwood AB, Taby (SE)

( * ) Notice: Subject to any disclaimer, the term of this patent is extended or adjusted under 35 U.S.C. 154(b) by 0 days.

(21) Appl. No.: 09/308,689

(22) PCT Filed: Dec. 11, 1997

(86) PCT No.: PCT/SE97/02069

§ 371 Date: May 24, 1999

§ 102(e) Date: May 24, 1999

(87) PCT Pub. No.: WO98/25740

PCT Pub. Date: Jun. 18, 1998

(30) Foreign Application Priority Data

Dec. 13, 1996 (SE) ..... 9604598
Nov. 17, 1997 (SE) ..... 9704212

(51) Int. Cl.[7] ..... B27B 1/00
(52) U.S. Cl. ..... 144/377; 83/75.5; 144/378
(58) Field of Search ..... 144/378, 377, 144/3.1; 83/75.5

(56) References Cited

U.S. PATENT DOCUMENTS 1,146,655 A * 7/1915 Rodes
2,316,111 A * 4/1943 Stamm
3,903,943 A * 9/1975 Hasenwinkle
4,149,577 A * 4/1979 Matusewicz et al.
4,538,656 A * 9/1985 Wiklund
4,895,197 A * 1/1990 Anderson
5,109,899 A * 5/1992 Henderickson
5,373,878 A * 12/1994 Walker
6,032,709 A * 3/2000 Knorr

FOREIGN PATENT DOCUMENTS

| | | |
|---|---|---|
| DE | 30 18 985 | 12/1980 |
| EP | 0 518 246 | 12/1992 |
| SE | 505 056 | 9/1992 |

* cited by examiner

*Primary Examiner*—Kenneth E. Peterson
(74) *Attorney, Agent, or Firm*—Young & Thompson

(57) ABSTRACT

The invention relates to a method for cutting a log into pieces. The log is cut into pieces with at least two nearly diametrical cuts (S1, S2), where the outermost lie essentially symmetrically around the pith of the stock. Each so-obtained plank is edged (S7, S8) with the outer side as a reference for the trimming direction. Two planks are formed through a cut (S9, S10) being placed near to the pith essentially parallel with each edged outer side. The cutting is performed on the outermost part of the log with the alignment cut (S3, S4) essentially parallel with the nearly diametrical cuts (S1, S2) preferably in the same operation as the cutting into pieces with the nearly diametrical cuts. Each block with the alignment cut (S3, S4) is conveyed through at least one twin-bladed saw, the cuts of which are inclined with respect to the base surface of the block, for example 30° and cut essentially radially symmetrically around the position of the pith. This can be performed twice with different inclinations in a twin-bladed saw.

7 Claims, 3 Drawing Sheets

METHOD FOR CUTTING UP LOGS

The present invention relates to a method of the type as stated in claim 1. In particular the method relates to the dividing of logs of wood into parts in order to obtain timber with vertical annual rings.

The invention has occurred during development work on the method which is described in SE 9100830. According to this method the log is first divided with at least two parallel longitudinal cuts which are substantially diametrical and parallel to the pith. Thereby at least one diametrical and plane parallel slab of wood is obtained which in its middle has a part made of the pith of the log. Furthermore a pair of essentially half logs are obtained. Further planks with vertical annual rings are obtained out of these through cutting with substantially radial cuts at an angel towards the pith. There remain pieces of wood with triangular cross-sections which can be glued together in the longitudinal direction with the triangular points pointing in opposite directions for adjacent pairs of pieces of wood in order to make a block with an even thickness and straight edges. Several blocks can be glued together to form thicker blocks which can be used as starting material for further manufacturing of wooden goods. This method gives an extremely high yield from the log and good quality of the finished timber.

The cut or cuts which are substantially diametrical and parallel to the pith give plane parallel slabs of wood which in their middles contain the pith of the log. The pith part in a log is of bad quality and therefore can not be used in timber. It is therefore cut away. The pith part in a log is considerably wider at the base of the log near its root. Therefore previously either a large part of the lower end of the log has been cut off or a large part of the middle of the slab or slabs of timber have been cut away after the initial cross cut sawing.

OBJECTS OF THE INVENTION

An object with the invention is to achieve an even better yield from a log and an even better quality of the timber after dividing into pieces.

Another object with the invention is to provide a way of working for cutting into pieces which requires so few operations as possible and which preferably can be controlled remotely.

Yet another object with the invention is to provide a system for dividing logs into pieces which gives low labour costs and/or low investment costs.

BRIEF DESCRIPTION OF THE INVENTION

The above mentioned objects are achieved with a method which has the characteristics stated in claim 1. Further characteristics and further developments are mentioned in the other claims.

According to the invention the log is first cut into parts by a band or circular saw with at least two nearly diametrical cuts where the outmost lie symmetrically around the pith of the log. Each so obtained wide central plank is divided up through a pith cut so that two radial planks are obtained. Each radial plank is edged with the outer side as a reference for lining up and such that its edges become substantially parallel. In this way the influence of that the pith of the log is wider in the root part is avoided and each plank has good quality.

At the same time as the nearly diametrical cuts, the outermost part of each side of the log can be cut off with alignment cuts which are parallel with the nearly diametrical cuts. This is done so that the cuts lie so close to the edges as possible at the top end of the log. In this way a later shoulder is obtained which is wider at the root end of the approximately cone shaped blocks obtained on each side of the middle plank.

Each approximately conical block with the alignment cut is guided further through a twin-bladed saw, the cuts of which slant at 30° towards the base surface of the block, and which cuts essentially radially symmetrically around the pith layer. The remaining part can then be turned the other way round and be cut by the same twin-blades saw in the same way. The two so obtained planks are edged. Alternatively, the log can be guided through two-twin blades saws, one after the other, which lean at 30° in opposite directions. These saws can be displaced a relatively small amount in relationship to each other, but they can also be placed in different saw units so that the log is first completely guided through the first saw and then afterwards sawn in the opposite direction in the other saw.

ADVANTAGES WITH THE INVENTION

The middle plank gives boards of good quality because the pith wood has been cut away.

A saw line in accordance with the invention in a basic embodiment can be equipped with machines which can be managed by four men. It gives a high yield of timber. Through remote controlling the output in a conventional way via for example TV cameras, the saw line can be handled by as few as two or three men which gives a high productivity of sales value per employee, considerably higher than in systems which were known before the invention.

BRIEF DESCRIPTION OF THE FIGURES

The invention is described more closely below with reference to the accompanying drawings, where.

Figure 1:
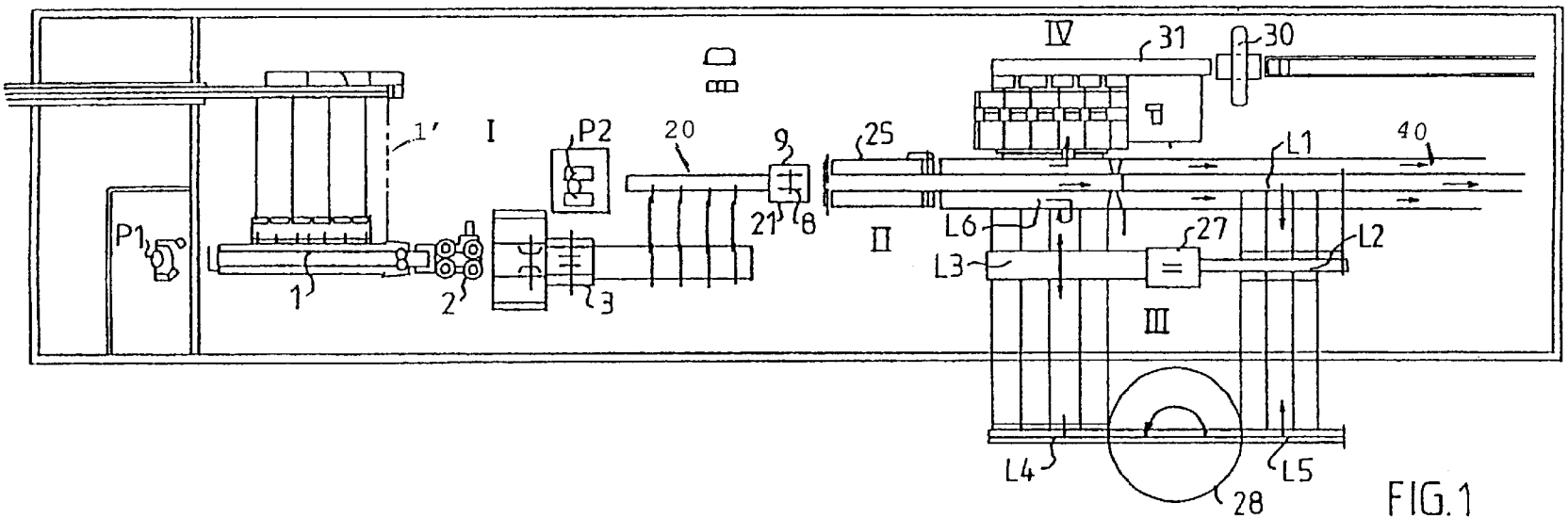
FIG. 1 shows a saw line with machinery for feeding and sawing of timber in accordance with the invention.

As is evident from FIG. 1, the timber 1 is placed by means of a conveying device 1' in a timber feeder 2 wherein a first work station I supervised by a person P1 has a saw 3, for example of the band saw type with two or four bands. Alternatively saw blades can be used, but this gives a lower yield of timber.

Figure 2A:
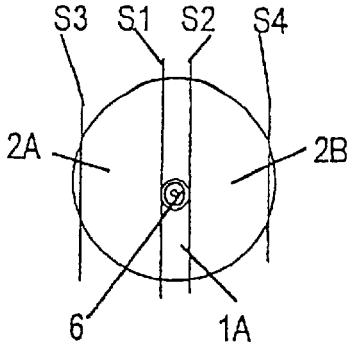
FIG. 2A shows a cross section through a log and shows the positions for the first cuts.

As is evident from FIG. 2A each log is sawn in at least two nearly diametrical parallel cuts S1 and S2, where the outmost lie on each side of the pith part of the log in order to produce at least one centre plank 1A containing the pith part 6. The number of nearly diametrical cuts depends on the desired thickness of the finally obtained planks. For the sake of simplicity below only the formation of two planks will be described but the skilled person clearly can see how more planks than this can be processed.

In addition the sector cuts S3 and S4 are made parallel to the cuts S1 and S2. All the cuts can be cut with band saws but it is alternatively possible to saw all the cuts with saw blades, or the cuts S1 and S2 with bands and the cuts S3 and S4 with saw blades. It is also possible to only saw the cuts S1 and S2 in the work station 1 and to perform the cutting to length at S3 and S4 at a later opportunity, for example with the outer reducers.

The log 1 is advantageously laid in the timber feeder 2 so that a possible lifting hook (not shown) is placed upwards or downwards. In this way there is a high likelihood that the pith is caught in such a position that the high quality parts should be able to be obtained in the next machinery 20 during operation II where the sawn apart parts 1A, 2A and 2B are further processed.

The machinery 20 comprises preferably a rip saw 21. The machine 21 can advantageously have two or three laterally movable blades or saw bands. Planks are made first of all from the middle piece 1A.

Figure 2B:
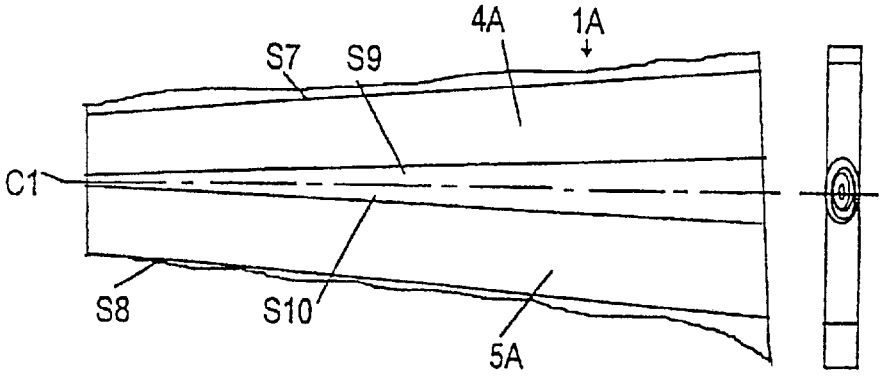
FIG. 2B shows a longitudinal section through the middle plank obtained and the cuts which should be made.
Figure 2C:
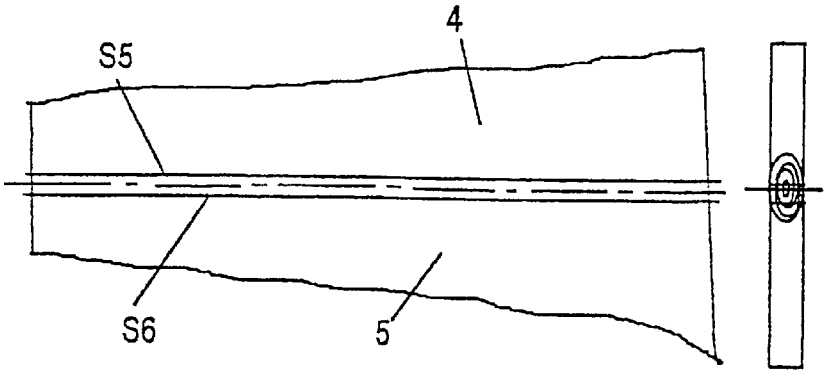
FIG. 2C shows the first cuts which are made in the middle plank obtained.

FIG. 2B shows how log 1A should be cut in order to obtain two planks with parallel sides. The flat middle plank 1A is approximately trapezoidal with wider parts down towards the root and the greatest curvature of the pith lying near to the root end. The cuts S7 and S8 are made near to the outside of the plank. The cuts S9 and S10 are made on each side of the pith part 6 each parallel with its outer side.

The log shown in FIG. 2B is drawn with exaggerated curvature. If a log had such a shape in reality then possibly other marking for cross cutting would have to be made in order to obtain the maximal yield. In this case short planks from the root part and longer planks from the top part of the log would be preferable. This can be judged and managed by the person who is monitoring the machinery during operation II.

In the operation II the cut out middle plank 1A is preferably divided through a saw blade or a saw band cutting through the pith or on each side of this with straight mutually parallel cuts S5 and S6 in/or extremely close to the pith. The remaining parts will then be two approximately trapezoidal planks 4 and 5. These planks have their fibre direction parallel with the outerside of the wooden log. Clean cutting with straight cuts S7 and S8 along the outer edges which are inclined in relationship to a central line C1 through the pith can take place either in operation II (not shown) or later in operation II.

The cut out part or parts of lower quality can be conveyed further for chopping up into chips.

The planks 4 and 5 are then conveyed further with the transporter 25 to the machine III, the way of working of which will be described more closely further on in the description.

Figure 3:
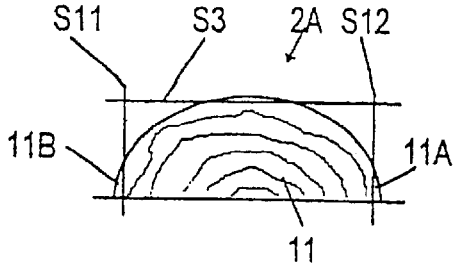
FIG. 3 shows the first cuts through each and all of the approximately conically shaped outer blocks.

In the machine 21 during operation II the cutting up of the two essentially semicircular side pieces 2A and 2B is performed. One side piece 2A is shown in FIG. 3, the other has in principle the same shape. The cut S3 is preferably already sawn in operation I. The side piece 2A is laid flat on the cross cutting table. The machine 21 performs the cross cuts S11 and S12 of the outer surfaces 11A and 11B in the lower part according to FIG. 3 with blades 8 and 9 which are adjustable in width. The cuts are made here parallel with each other and such that the top end is not or is only lightly affected by the cuts while a guide surface is formed near to the root. This is important in order to lose as little as possible of the timber yield.

The produced block 11 is conveyed further in a transporter 25 to a machine IV. The cut off parts 11A and 11B are conveyed away for example for chopping up (not shown).

In operation III the trapezoidal plank material 4 and 5 (see FIG. 4) are made into finished parallelepiped planks. Each plank is conveyed to the position L1, where it is fed to the input position L2 for a first sawing in the saw 27.

As is evident from FIG. 2B the planks 4 respectively 5 shall in this case be placed so that a cut S7 respectively S8 can be made parallel with the outerside (the bark side) of the plank so that the fibre direction will be in the same direction as the cut S7 respectively S8 and so close to the outside as possible where the tree has fewer knots. The earlier performed cuts S5 respectively S6 can give a straight edge so that guide (not shown) which can be adjusted obliquely set at a chosen angular position against which the straight edge lies, can form a guide for the desired cutting position for S7 respectively S8.

Figure 4:
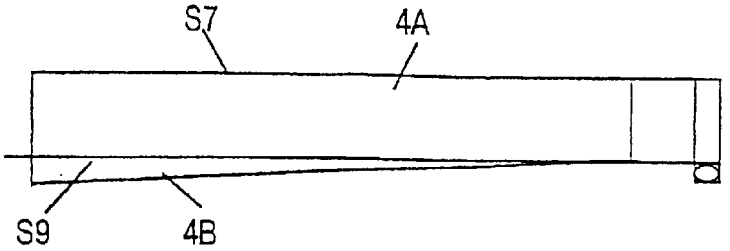
FIG. 4 shows the cutting of the bits of the plank which are obtained after the cuts in FIG. 2C, and FIG. 5 and FIG. 6 show radial cutting out of a plank.

The planks which have been cut along the cuts S7 respectively S8 have the shape which is shown in FIG. 4 and after sawing are in the position L3. Thereafter they are conveyed first from the position L3 to the position L4 and therefrom to a turntable 28 where they are turned. They are then fed to the position L5 in order to be conveyed back in the reversed position L2 in order to once more be conveyed through the saw 27.

A cut S9 respectively S10 is made at the parts close to the pith and such that at the root end a large amount of the juvenile wood which is of worse quality than the rest is removed. The cuts S9 respectively S10 are herewith placed parallel with S7 respectively S8 which means that the guide against which the cut side S7 respectively S8 now rest has been positioned parallel to the direction of sawing. The removed part 4B in this case is triangular and can, for example, be chopped up and the remaining plank 4A has become parallelepiped. This is then conveyed from the position L3 to the position L6 in order to be fed out as finished planks from the saw line.

Both plank materials 4 and 5 are processed in the same way, suitably after one another.

Figure 5:
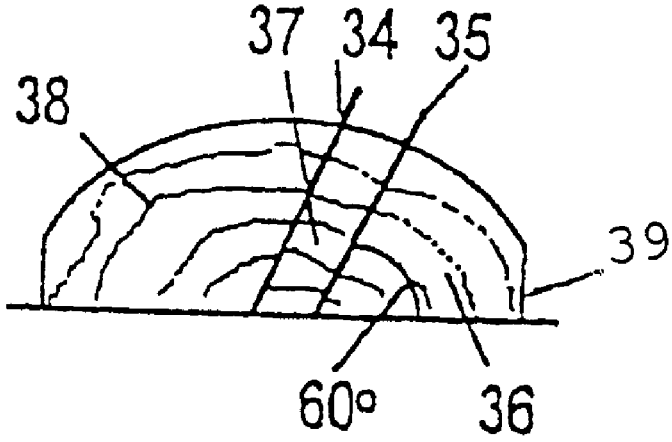

In the operation IV which possibly can be supervised by the same person P3 as the operation III, the two cut curved parts 11 are transported to a twin band or chain saw for example 30 with two parallel saw blades which preferably incline 30°, which in FIG. 5 have the reference numerals 34 and 35. The cuts performed with these saw blades shall be positioned so that a part 36 shaped like a 60° sector of a circle is formed together with a plank 37. Furthermore a block 38 shall remain for further processing. The stated number of degrees for the inclination can be selected in another way. Furthermore, it is possible to choose more than two double cuts.

The part 11 conveyed to the feed device 31 for the saw 30 is fed through the saw 30 with the root end first and in this way is guided by at least one guide surface 39 at the root end with a longitudinal rule (not shown).

The approximately triangular part 36 is conveyed away via a transporter 40 for drying or further processing and the plank 37 is conveyed via the same transporter 40 or some other to an edging mill (not shown) where it is trimmed in a conventional manner.

Figure 6:
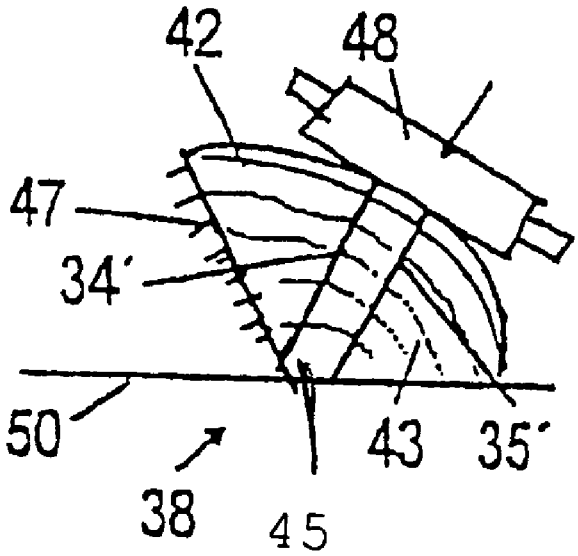

The block 38 is conveyed back to the device 31 and therefrom to the block turner 28 (which turns the block 180° root to top) and then returns to the device 31 for further transport through the band saw which, as shown in FIG. 6, saws up the block into two parts 42 and 43 with essentially a triangular cross section and a plank 45. Thecuts 34' and 35' are placed substantially each on one side of the part which borders the pith part. The plank 45 is transported to the edging mill and trimmed in a conventional manner. The parts 42 and 43 with triangular cross sections are transported for drying and/or further processing.

In order to stabilise the cuts from the beginning when the block 38 is returned with the top end first as an alternative as is shown in FIG. 6, a guide stop 47 can be moved for example hydraulically in the band saw. The guide stop 47 will then be inclined approximately 60° with respect to the base plane. The block's 38 obtuse 120° angle will thereby be adapted to lie in line with the intermediate position between the two 30° inclined saw blades 34' and 35'. By means of a pressing means 48, for example in the shape of a roller, pressing the block 38 downwardly inclined preferably 60° towards the base plate 50 a positioning in the right position at least at the beginning of the sawing is obtained. After the sawing has begun the pressing means 48 can, however, be removed as the guide stop's 47 vertical guidance takes over.

Instead of sawing the half logs in two goes with turning after the first sawing the saw 30 can be provided with either two sets of pairs of saws where each pair is inclined 60° in different directions with respect to the base blade and each pair displaced in the direction of sawing so that they do not work against each other. Alternatively, the two sets of pairs of saws can be placed so long after each other that the log is sawn in its entirety in two operations. Alternatively the same pair of saws can be adjustable from being inclined in one direction to be inclined in the other direction and the log conveyed twice through the saw. In all these cases two planks are obtained per half log which are conveyed to a conventional edging mill to be trimmed and three triangular parts which are conveyed further for drying and further processing.

What is claimed is:

1. A method for dividing a log into pieces, comprising the steps of:

performing at least two nearly diametrical cuts arranged essentially symmetrically along opposite sides of a pith of the log to produce a plank from a central portion of the log and two outer blocks, the plank having a width corresponding to a diameter of the log, a length corresponding to an axial length of the log, and a thickness corresponding to a distance between the nearly diametrical cuts;

performing two parallel cuts through the thickness positioned at respective edges of the pith to create two sub-planks;

in each of the sub-planks, performing an edging cut through the thickness of the plank generally along the sub-plank's length;

in each of the sub-planks, after performing the edging cut, performing a second thickness cut essentially parallel to the edging cut;

wherein each of the edging cuts is aligned to generally follow an outer edge of the plank, and wherein a position of the edging cuts on a plank are not parallel with one another; and wherein each of the second thickness cuts is positioned to be a maximum distance from the corresponding edging cut while ensuring that the sub-plank includes no said pith.

2. The method according to claim 1, comprising the further step of cross cutting an outmost parts of the log with alignment cuts (S3, S4) essentially parallel with the nearly diametrical cuts (S1, S2).

3. The method according to claim 2, comprising the further step of conveying a first of the two outer blocks through at least one twin-bladed saw, each blade of the twin-bladed saw making a cut arranged to be substantially radial with respect to the pith.

4. The method according to claim 3 wherein after cutting the first of the two outer blocks with the twin-bladed saw, a second of the two outer blocks is turned around and cut by the twin-bladed saw.

5. The method according to claim 3, wherein a second said twin-bladed saw is provided, blades of the twin-bladed saws being inclined 30° in different directions with respect to a base surface of the block created by the nearly diametrical cut, the twin-bladed saws being displaced along a direction of movement of the log during sawing.

6. The method of claim 3, wherein each of the cuts of the twin-bladed saw lies at approximately 30° to a surface of the block created by the nearly diametrical cuts.

7. The method of claim 2, wherein the cross cutting step is performed simultaneously with the step of performing the nearly diametrical cuts.

* * * * *